United States Patent [19]

Shlesinger, Jr. et al.

[11] 4,038,620

[45] July 26, 1977

[54] MAGNETIC REED SWITCH

[76] Inventors: B. Edward Shlesinger, Jr., 9411 Macklin Court, Alexandria, Va. 22309; Charlie Dwain Mariner, 2846 Greenway Blvd., Falls Church, Va. 22042

[21] Appl. No.: 611,156

[22] Filed: Sept. 8, 1975

Related U.S. Application Data

[60] Continuation-in-part of Ser. No. 533,223, Dec. 16, 1974, Pat. No. 3,943,474, which is a division of Ser. No. 404,612, Oct. 9, 1973, Pat. No. 3,866,007.

[51] Int. Cl.[2] ..... H01H 1/66

[52] U.S. Cl. ..... 335/153; 335/207

[58] Field of Search ..... 335/151, 152, 153, 154, 335/205, 206, 207

[56] References Cited

U.S. PATENT DOCUMENTS

| | | | |
|---|---|---|---|
| 2,264,746 | 12/1941 | Ellwood | 335/154 |
| 2,922,856 | 1/1960 | Kanrer | 335/154 |
| 3,205,323 | 9/1965 | Deshautreaux | 335/207 |
| 3,283,274 | 11/1966 | DeFalco | 335/206 |
| 3,359,385 | 12/1967 | Bentz et al. | 335/205 X |

*Primary Examiner*—George Harris

*Attorney, Agent, or Firm*—Shlesinger, Arkwright, Garvey & Dinsmore

[57] ABSTRACT

A reed switch which comprises a first reed of conductive material and a second reed of conductive non-magnetic material mounted in cooperating spaced relation to said first reed. The first reed comprises a body of conductive material having a contact section, an intermediate spring section and a support section, with the intermediate section being foil thin and the contact section being substantially rigid and non-flexible and being substantially thicker than said intermediate section. The intermediate section comprises a leaf spring having a flexibility permitting one end of said leaf spring to flex a substantial distance through an arc with respect to the other end of said leaf spring without exceeding the elastic limits of said spring. The intermediate section is cold-worked to a point where said conductive material assumes a substantial change in physical characteristics and is substantially harder, less ductile and more dense than said contact section and has a substantially higher tensile strength than said contact section. This invention also includes a magnetic operator mounted in cooperating spaced relation to said first and second reeds, whereby cooperative operation of said magnetic operator with said magnetic reed causes said magnetic reed to move into or out of contact with said non-magnetic reed.

67 Claims, 19 Drawing Figures

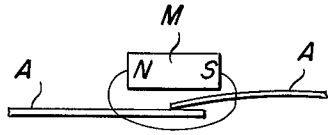
Prior Art
Fig. 1
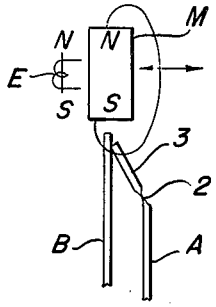
Fig. 2
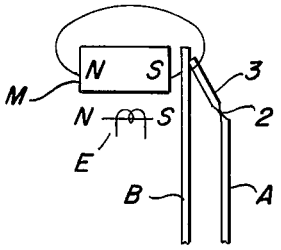
Fig. 3
Fig. 4
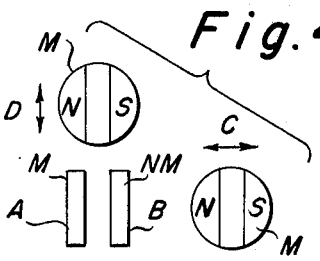
Fig. 5
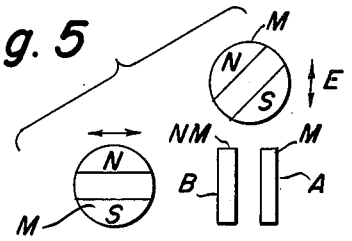
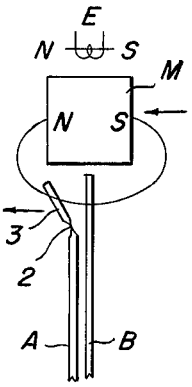
Fig. 6
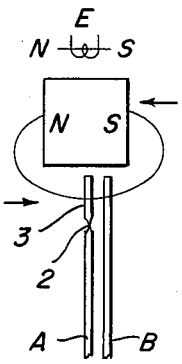
Fig. 7
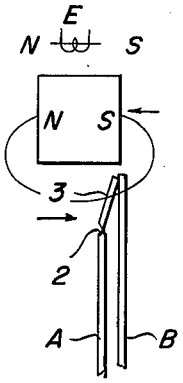
Fig. 8
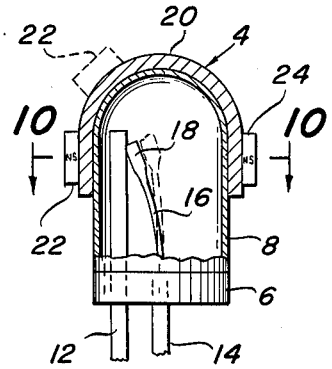
Fig. 9
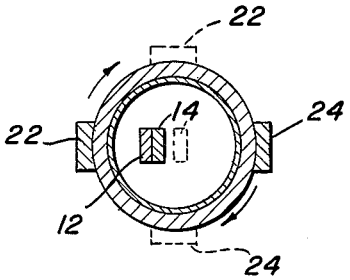
Fig. 10

Fig. 11
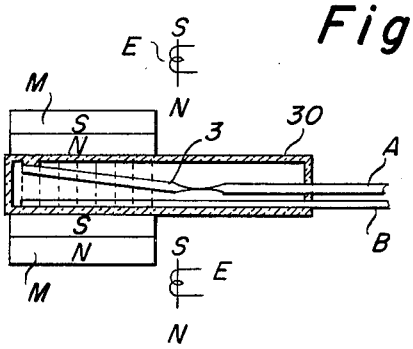
Fig. 15
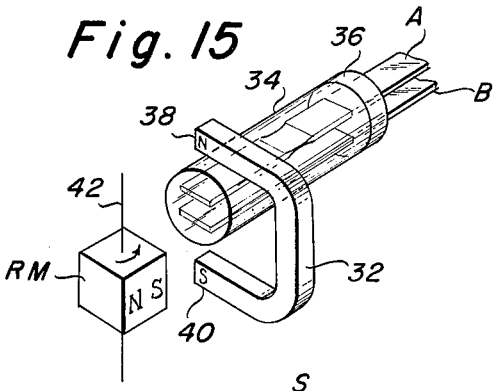
Fig. 12
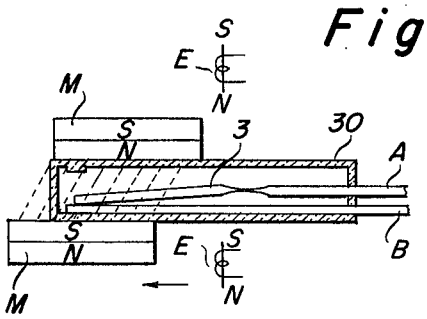
Fig. 16
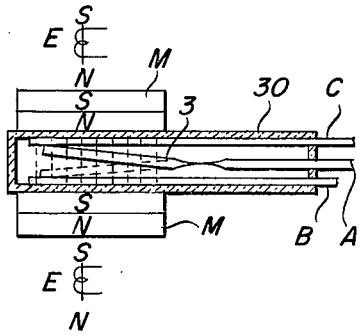
Fig. 13
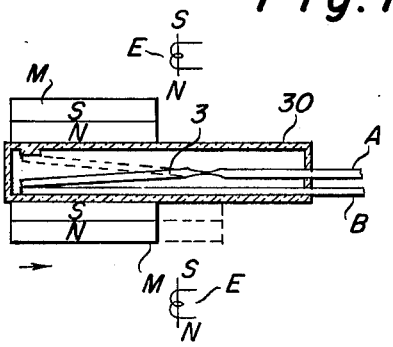
Fig. 17
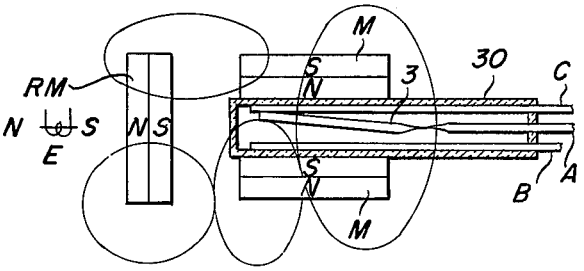
Fig. 14
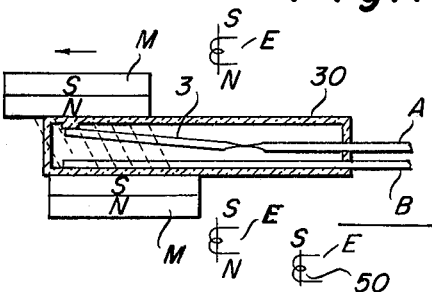
Fig. 18
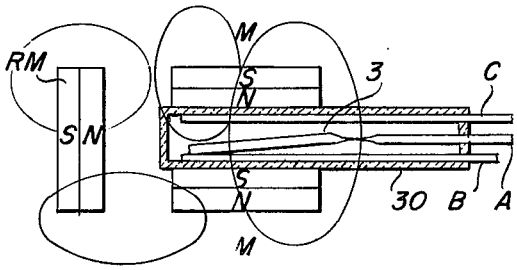
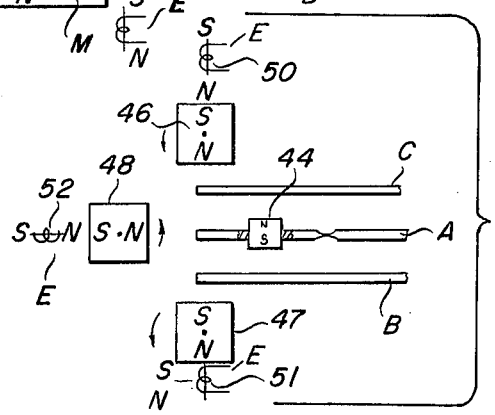
Fig. 19

MAGNETIC REED SWITCH

This invention is a CIP of our Ser. No. 533,223, filed Dec. 16, 1974, now U.S. Pat. No. 3,943,474 which case is a division of Ser. No. 404,612, filed Oct. 9, 1973, now U.S. Pat. No. 3,866,007, issued Feb. 11, 1975.

FIELD OF INVENTION

This invention relates to magnetically operated reed switches in which one of the reeds is of magnetic materials and another of the reeds is non-magnetic material.

HISTORICAL BACKGROUND

Very little has been done in the area of reed switches using a non-magnetic reed with a magnetic reed. U.S. Pat. Nos. Ellwood 2,264,746, Karrer 2,922,856, and Bentz 3,359,385 to disclose magnetic reeds working in conjunction with non-magnetic reeds; however, in each instance, there is a third reed which is magnetic and the actual operation of the switches is dependent upon a magnetic field acting upon the two magnetic reeds to cause them to close together to complete an electrical circuit at the same time as the two magnetic reeds complete a magnetic circuit. In these patents, the magnetic forces bring the reeds together so that the magnetic circuit is closed. The operation of the switches of this invention are not at all based upon the completion of a magnetic circuit as is typical in prior art magnetic reeds. Operation of this invention is dependent only on the attraction or repulsion of a single reed and the magnetic forces as they affect this reed. There is no completion of a magnetic circuit when the device is operating as in the case of the prior art, where the non-magnetic reed is merely positioned for a single pole-double throw system in which one of the magnetic reeds rests against the non-magnetic reed prior to operation of the magnetic field effect.

In addition to the art referred to, attention is called to DeFalco U.S. Pat. No. 3,283,274 and Shlesinger U.S. Pat. No. 3,760,312 which are typical of the prior art not including a non-magnetic reed.

Attention is also called to our U.S. Pat. No. 3,893,051 of July 1, 1975, which discloses electromagnetic devices operating on a typical reed system such as disclosed in this invention.

OBJECTS AND SUMMARY

It is therefore an object of this invention to provide a magnetic reed switch which allows for greater reduction in size and an increase in current carrying capacity greater than heretofore available.

It is a further object of this invention to provide a magnetic reed switch which can be inexpensively and readily manufactured.

Another object of this invention is to provide a magnetic reed switch which has great durability and which can take severe strain and stress and can withstand high acceleration and deceleration forces without actuation.

Yet a further object of this invention is to provide a magnetic reed switch which incorporates therein a magnetic conductive reed and a non-magnetic conductive reed capable of being operated by one or more permanent or electromagnets.

Yet a further object of this invention is to provide a magnetic reed switch having many options of operation including various on-off combinations and directional control operation.

It is a further object of this invention to provide a magnetic reed switch which has an extremely rapid closing time.

Yet another object of this invention is to provide a magnetic reed switch in which a minimum amount of work is done in order to operate the switch.

Yet another object of this invention is to provide a reed switch which has a strong snap action so as to crunch or otherwise break through any oxide build-up increasing the longevity of the switch and eliminating malfunction.

Yet a further object of this invention is to provide a magnetic reed switch which has good contact wipe characteristics.

Still a further object of this invention is to provide a reed switch which improves conductivity characteristics with use.

A further object of this invention is to provide a magnetic reed switch which can be adapted to many shapes and forms.

Still a further object of this invention is to provide a magnetic reed switch capable of being used in linear and radial configurations and combinations.

A further object of this invention is to provide a reed switch which can be latched into two different modes of operation.

A further object of this invention is to provide a reed switch which is operable by rotary or reciprocable action.

Yet another object of this invention is to provide a magnetic reed switch which may be operated through a very short incremental distance.

In summary therefore, this invention is directed to magnetic reed switches of either the permanent or electromagnetic type having a strong closing action and long life. These and other objects of this invention will be apparent from the following description and claims.

In the accompanying drawings which illustrate by way of example various embodiments of this invention:

FIG. 1 is a side elevational view schematically showing the prior art;

FIGS. 2 and 3 are side elevational views schematically showing various modes of operation of this invention;

FIGS. 4 and 5 are diagrammatic views illustrating the reeds and magnetics of various embodiments of this invention;

FIGS. 6, 7 and 8 are side elevational views schematically showing a first, second and third stage of operation of a mode of this invention;

FIG. 9 is a side elevational view showing one reed in closed position in solid lines and an open position in phantom lines with the ends of the reeds fragmented;

FIG. 10 is a fragmentary cross sectional view of the embodiment shown in FIG. 9 taken along the lines 10—10 and viewed in the direction of the arrows;

FIGS. 11, 12, 13 and 14 are side elevational views schematically showing four steps in the operation of another embodiment of this invention;

FIG. 15 is a diagrammatic fragmentary isometric view of yet a further embodiment of this invention;

FIGS. 16, 17 and 18 are side elevational diagrammatic views of yet another embodiment of this invention in various phases of operation;

FIG. 19 is a side elevational diagrammatic view of still another modification of this invention.

FIGS. 1 THROUGH 3

The prior art is generally shown in FIG. 1 in which magnetic reeds A are mounted in spaced relationship so that when a magnet M has its magnetic polar axis generally parallel to the longitudinal axis of the reeds A, they will be drawn together in contact relationship thereby completing the magnetic circuit as shown in the phantom lines.

In FIGS. 2 and 3 there is only one magnetic reed A and a non-magnetic reed B. Magnetic reed A includes a hinge 2 adjacent the contact end 3 which provides greater mass than the hinge 2. When the magnet M is passed in the direction of the arrows, the reeds A are attracted to the magnets M and thus the switch is closed. The hinge 2 allows for the contact area 3 to be easily pulled in the direction of the magnet M when the magnetic field influences the magnetic conducting material of the reed A. It will be obvious that instead of a permanent magnet M, an electromagnet E may also be used as shown in FIGS. 2 and 3. The hinge 2 has a cross sectional thickness of less than 0.001 inches and flexes through an arc of at least 25°.

It will be obvious that operation may take place with either the permanent magnet M or the electromagnet E or the reeds A and B moving relative to each other. The magnetic operator M may remain stationary and the reeds A and B move, or vice versa, or both the reeds A and B and the operator M may move simultaneously to open or close the switch.

FIGS. 1 THROUGH 8

In FIGS. 4 through 8, the magnets M are shown as disc magnets although they may be bar magnets. In FIGS. 4 through 8, the magnets M are designed to pass across the tips of the reeds as best shown in FIGS. 6 through 8. It will now be observed in FIG. 4, as the magnet M, with poles oriented as shown, is moved to the left in the direction of the arrow C, contact will be made between the reeds A and B as the magnet M is passed across the contact end of the reed A, first moving it to the left as it is drawn by the force of the left pole of the magnet and subsequently will start to shift to the right, as illustrated in FIGS. 7 and 8, as it is suddenly released from the left pole and drawn to the right pole to wind up in the final position shown in FIG. 8. The action is extremely rapid and is a sudden snap from one pole towards the other pole in the closing or opening of the switch, as the case may be, depending upon the direction of travel of the magnet relative to the reeds. If the magnet M, with its poles oriented as illustrated, is positioned above the reeds A and B and is shifted in the downward direction of the arrow D, there will be no activation; thus, there is directional control by merely rotating the poles of the magnet relative to the reeds A and B.

With reference to FIG. 5, it will now be noted that if the magnet M is rotated slightly on its axis and then shifted in the direction of the arrow E downwardly, the magnet will permit operation of the switch in that the polar field of the magnet is not exactly 90° to the plane of the reeds A and B, but is at an angle thereto which permits the magnet M to operate the reed A. It will be noted that the magnetic field should entrap the magnetic reed A in order that it first move away from the non-magnetic reed B prior to its snapping closed when the magnet M is moved past the reeds A and B. Further, it will be noted that the positioning of the magnet M for movement in the direction of the arrow B, with its poles as illustrated, so that the magnetic field is parallel to the planes of the reeds A and B, will, upon shifting to the right, fail to operate the reeds, since the magnetic field is parallel to the planes of the reeds A and B. Thus again, rotation of magnet M provides directional control of the switch.

FIGS. 9 and 10

FIGS. 9 and 10 show a reed switch 4 which has a base 6 and an envelope 8 which may be of plastic or glass or other non-magnetic material and which may be provided with an inert atmosphere or vacuum as desired. Reeds 12 and 14 are mounted in the base 6. Reed 12 is of non-magnetic conductive material such as copper or aluminum or the like. Reed 14 is of magnetic conductive material such as soft steel and may be tin zinc plated with some other good contact material such as gold or silver. The intermediate spring foil like section 16 may extend from the base 6 to the contact section and details of this are set out in the parent case above cited. Mounted on the envelope 8 is a cap 20 which is rotatable thereon. The cap 20 is provided with magnets 22 and 24. The magnets 22 and 24 need not be positioned directly opposite each other and magnet 22 for example may be placed in the position shown in the dotted lines. If reference is now made to FIG. 10, it will be noted that when the magnets 22 and 24 are moved 90° to the position shown in the dashed lines, the switch remains open. When the cap is rotated another 90° in either direction, the switch is closed again and the closing action begins to occur approximately 45° from the perpendicular in FIG. 10. It is to be noted that the magnetic reed 14 is mounted in the same half of the capsule 4 as the non-magnetic reed 12. The reason is that the magnets 22 and 24 reinforce each other and tend to cause the contact 18 to move rapidly towards the reed 12. The reed 14 may be mounted in the other half of the capsule providing that the contact portion 18 extends into the same half in which the reed 12 is positioned. The magnetic influence therefore is operating primarily on the mass of the contact section 18 to drive it into contact with the non-magnetic conductive reed 12.

FIGS. 11 THROUGH 14

In FIGS. 11 through 14, the reeds A and B are mounted in a receptacle 30 as diagrammatically indicated. It is obvious that various types of receptacles can be utilized such as glass, plastic or the like which may be hermetically sealed or open to the atmosphere as the case may be. The permanent magnets M or the electromagnets E are shiftable on the case or housing 30. They may be secured to the case 30 for movement or otherwise closely associated therewith and supported by some other mechanism not shown. In FIG. 11, the magnets M are shown being positioned directly opposite each other and the lines of force are shown as perpendicular to the surface of the magnets M. If we assume that the reed A is in the open position as illustrated in FIG. 11 and biased against the upper wall of the envelope 30, a movement of the lower magnet M to the left as illustrated in FIG. 12 will cause a distortion of the magnetic lines diagonally so that they extend upwardly from left to right. This repositioning of the magnetic lines of force forms an acute angle with respect to the longitudinal axis of reed A, thus causing the reed A to slip in the direction of the reed B to align itself with the lines of force as it attempts to thereby make contact.

The primary reason for the shifting of the reed A is that the contact end 3 of the reed A endeavors to seek the course of least resistance and attempts to align itself with the lines of force. If now the lower magnet M is shifted to the full line position shown in FIG. 13, the reed A will not shift back to the position of FIG. 11 but will tend to stay in the contact position since there is no great overriding force to otherwise kick it in the other direction. This is particularly true if there is no bias of the spring hinge in either direction, but in relaxed position the reed would be extending straight. If, however, there is a spring bias in the upper direction, as aforementioned, the reed will then flip upwardly overcoming the lines of force and again be positioned against the upper casing of the housing 30 being drawn there by the upper magnet M. It will be observed that if the lower magnet M is shifted to the right, as in the dotted line position shown in FIG. 13, the lines of force will now be slanted in the opposite direction of those shown in FIG. 12, and thus there will be a decreasing of the holding power of the lower magnet M and an increasing of the holding power of the upper magnet M to thereby draw the reed A upwardly toward the upper magnet M, as illustrated in the dashed line position of FIG. 13.

Similarly, in FIG. 14, the upper magnet M may be shifted to the left relatively to the lower magnet M if the reed is in the hold down position as generally illustrated in the solid lines in FIG. 13 with the magnets M directly opposed to each other. Upon shifting of the upper magnet M to the left, it will be noted that the lines of force are diagonally directed in the opposite direction to those shown in FIG. 12, thus creating a greater force to draw the reed A towards the upper magnet M due to the attempt of the contact 3 to align itself with the lines of force. As aforementioned, either permanent magnets or electromagnets can be used for the operation of this system; however, it is important to note that the strongest pull results when the magnets M are positioned so that the magnets M reinforce each other, as shown, in that the lines of force and the polar axis are perpendicular to the reeds A and B as illustrated. Using the electromagnets E, the polar axis may be reversed upon reversing the flow of current in the coils of the electromagnets E.

FIGS. 15 THROUGH 19

FIG. 15 shows a horseshoe magnet 32 positioned about the capsule 34 in which reeds A and B are positioned within the base 36. The poles 38 and 40 are oriented so that the polar axis extending through the poles 38 and 40 is transverse to the planes of the reeds A and B. Rotating magnet RM which may be an electromagnet, rotates on an axis 42 so as to permit either the north or the south pole to be brought into close proximity to the magnetic field of the poles 38 and 40. Rotation of the magnet RM causes the reed A to move from one pole to the other as the influence of the rotating magnet m affects the force fields of the poles 38 and 40. Thus, when the north pole of the rotating magnet RM is introduced into the force field of the horseshoe magnet 32, it pushes against the north pole 38 and is additive with regard to the south pole 40 thus causing the reed A to be shifted in the direction of the south pole. Rotation again of the rotating magnet RM will cause a reversal of the process since now the south pole of the rotating magnet RM will be pushing against south pole 40 causing the reed A to be shifted towards the north pole 38 because of the additive effect.

It will be obvious that horseshoe magnet 32 may also be an electromagnet in which the horseshoe is the core upon which is wound a coil.

FIGS. 16, 17 and 18 show a housing 39 in which the magnetic reed A is positioned between non-magnetic reeds B and C for the purpose of providing a single pole-double throw switch mechanism. Upper and lower magnets M are provided which are fixed position magnets and the reed A may have its contact in the solid line up position or in the dotted line down position as illustrated in FIG. 16. It will be noted that the lines of force are substantially perpendicular to the reeds. It will now be observed in FIGS. 17 and 18 that the rotating magnet RM when having its south pole pushing the south pole of the lower magnet and aiding the north pole of the upper magnet will maintain the contact 3 of the reed A in the upper position, or if the contact 3 is in the lower position, it will shift it to the upper position due to the greater magnetic attractive forces influencing the magnetic field in the direction of the upper magnet. Similarly, as shown in FIG. 18, a reversal of the rotating magnet RM will shift the reed to the lower position since the magnetic forces are now switched to cause a greater attraction of the lower magnet than the upper magnet. Removing the rotating magnet RM will, of course, leave the contact 3 in whatever position it was at the time the rotating magnet was removed. This provides a latching mechanism for the switch and assures a positive positioning in either direction as desired. It is also to be noted that the influencing rotating magnet RM may be brought into position, not necessarily at the end of the reeds as illustrated in FIGS. 17 and 18, but may be brought into position anywhere within the range of the magnetic fields of the two stationary magnets which, of course, allows the positioning of the rotating magnet anywhere about the package so long as there is sufficient influence upon the fields of the two stationary upper and lower magnets. This phenomenon is unique and provides a switch with a memory characteristic. The reed will not flip out once it is positioned even though the magnet RM is shifted away and removed. Obviously, a belt system drive could move a series of magnets into position alternately switching the reed A from an up position to a down position. Although a single pole-double throw system is shown, it is obvious that other type systems could be utilized including single pole-single throw or double pole-double throw, etc.

In FIG. 19, the reed A is provided with a small permanent magnet 44. The upper magnet 46, the lower magnet 47 and the interfering magnet 48 are all rotatable and may be electromagnets 50, 51 and 52. In this instance, the small fixed permanent magnet 44 is utilized as a null or mid-position positioning magnet. Thus, if magnets 46 and 47 use repelling fields as illustrated, the reed A will be maintained in mid-position between the contact reeds B and C as illustrated. Any rotation of various magnets 46, 47 and 48 will, of course, affect the positioning of the reed A relative to the reeds B and C depending on the positioning of the pole of the magnets 46, 47 and 48 or the operation of the electromagnets 50, 51 and 52, which may be reversed so far as the current is concerned in order to shift the polarity of the electromagnets thus influencing the system. Thus, if the magnet 48 is strong enough to override any one of the systems, it will shift the reed A in the direction of the strongest system. Similarly, this is true with rotation or inversion of the magnets 46 and 47 or actuation of the electromagnets 50 and 51 to reverse fields as desired.

While this invention has been described, it will be understood that it is capable of further modification, and the application is intended to cover any variations used and/or adaptations of the invention following, in general, the principle of the invention and including such departures from the present disclosure as come within known or customary practice in the art to which the invention pertains, and as may be applied to the essential features hereinbefore set forth, as fall within the scope of the invention or the limits of the appended claims.

Having thus described our invention what we claim is:

1. A reed switch comprising:
a. a first reed of conductive magnetic material
b. a second reed of conductive non-magnetic material mounted in cooperating spaced relation to said first reed.
c. said first reed comprising a body of conductive material having a contact section, an intermediate spring section and a support section
d. said intermediate section being foil-thin
e. said contact section being substantially rigid and non-flexible
f. said contact section being substantially thicker than said intermediate section
g. said intermediate section comprising a leaf spring having a flexibility permitting one end of said leaf spring to flex a substantial distance through an arc with respect to the other end of said leaf spring without exceeding the elastic limits of said spring.
h. said intermediate section being substantially harder, less ductile and more dense than said contact section and having a substantially higher tensile strength than said contact section
i. a magnetic operator mounted in cooperating spaced relation to said first and second reeds
j. whereby cooperative operation of said magnetic operator with said magnetic causes said magnetic reed to move into or out of contact with said non-magnetic reed.

2. A reed switch as in claim 1 and wherein:
a. said magnetic operator is positioned to operate when the magnetic flux lines are substantially oriented with the longitudinal axis of said magnetic reed.

3. A reed switch as in claim 1 and wherein:
a. said magnetic operator is positioned to operate so that the magnetic flux lines are substantially transverse to the longitudinal axis of said magnetic reed.

4. A reed switch as in claim 1 and wherein:
a. said reeds and said operator move relative to each other.

5. A reed switch as in claim 1 and including:
a. a pair of said magnetic operators.

6. A reed switch as in claim 5 and wherein:
a. said reeds are positioned between said operators.

7. A reed switch as in claim 5 and wherein:
a. said magnetic operators are positioned to operate when the magnetic flux lines are greater than 45° with respect to the plane of the reeds.

8. A reed switch as in claim 5 and wherein:
a. said magnetic operators when operating are aiding.

9. A reed switch as in claim 5 and wherein:
a. said magnetic operators when operating are opposing.

10. A reed switch as in claim 5 and wherein:
a. said magnetic operators are rotatable about said reeds.

11. A reed switch as in claim 5 and wherein:
a. at least one of said magnetic operators includes polarity reversing means.

12. A reed switch as in claim 11 and wherein:
a. said polarity reversing means includes at least one rotatable permanent magnet.

13. A reed switch as in claim 11 and wherein:
a. said polarity reversing means includes at least one electromagnet.

14. A reed switch as in claim 1 and wherein:
a. said magnetic operator includes a permanent magnet.

15. A reed switch as in claim 1 and wherein:
a. said magnetic operator includes an electromagnet.

16. A reed switch as in claim 1 and wherein:
a. said magnetic operator is rotatable on its axis.

17. A reed switch as in claim 1 and wherein:
a. said magnetic operator is linearly movable.

18. A reed switch as in claim 5 and wherein:
a. at least one of said pair of magnetic operators is movable relative to the other.

19. A reed switch as in claim 5 and wherein:
a. said first reed is positioned approximately mid-way between said operators.

20. A reed switch as in claim 5 and wherein:
a. said first reed is positioned closer to one operator than the other.

21. A reed switch as in claim 5 and wherein:
a. at least one of said magnetic operators is movable along an axis substantially parallel to the plane of said reeds.

22. A reed switch as in claim 21 and including:
a. a third conductive non-magnetic reed, and
b. said first reed is positioned intermediate said second and third reeds.

23. A reed switch as in claim 1 and wherein:
a. said operator is a horseshoe magnet.

24. A reed switch as in claim 1 and wherein:
a. said intermediate section flexes through an arc of at least 25°.

25. A reed switch as in claim 24 and including:
a. a plurality of said magnetic operators cooperating with each other and in cooperating spaced relation to said reeds.

26. A reed switch as in claim 24 and wherein:
a. said operator is a horseshoe magnet.

27. A reed switch as in claim 1 and wherein:
a. said intermediate section cross sectional thickness is less than 0.001 inches.

28. A reed switch as in claim 27 and wherein:
a. said magnetic operator is positioned to operate when the magnetic flux lines are substantially oriented with the longitudinal axis of said magnetic reed.

29. A reed switch as in claim 27 and wherein:
a. said magnetic operator is positioned to operate so that the magnetic flux lines are substantially transverse to the longitudinal axis of said magnetic reed.

30. A reed switch as in claim 27 and wherein:
a. said reeds and said operator move relative to each other.

31. A reed switch as in claim 27 and including:
a. a pair of said magnetic operators.

32. A reed switch as in claim 31 and wherein:
a. said reeds are positioned between said operators.

33. A reed switch as in claim 31 and wherein:
a. said magnetic operators are positioned to operator when the magnetic flux lines are greater than 45° with respect to the plane of the reeds.
34. A reed switch as in claim 31 and wherein:
a. said magnetic operators when operating are aiding.
35. A reed switch as in claim 31 and wherein:
a. said magnetic operators when operating are opposing.
36. A reed switch as in claim 31 and wherein:
a. said magnetic operators are rotatable about said reeds.
37. A reed switch as in claim 31 and wherein:
a. at least one of said magnetic operators includes polarity reversing means.
38. A reed switch as in claim 37 and wherein:
a. said polarity reversing means includes at least one rotatable permanent magnet.
39. A reed switch as in claim 37 and wherein:
a. said polarity reversing means includes at least one electromagnet.
40. A reed switch as in claim 27 and wherein:
a. said magnetic operator includes a permanent magnet.
41. A reed switch as in claim 27 and wherein:
a. said magnetic operator includes an electromagnet.
42. A reed switch as in claim 27 and wherein:
a. said magnetic operator is rotatable on its axis.
43. A reed switch as in claim 27 and wherein:
a. said magnetic operator is linearly movable.
44. A reed switch as in claim 31 and wherein:
a. at least one of said pair of magnetic operators is movable relative to the other.
45. A reed switch as in claim 31 and wherein:
a. said first reed is positioned approximately mid-way between said operators.
46. A reed switch as in claim 31 and wherein:
a. said first reed is positioned closer to one operator than the other.
47. A reed switch as in claim 31 and wherein:
a. at least one of said magnetic operators is movable along an axis substantially parallel to the plane of said reeds.
48. A reed switch as in claim 47 and including:
a. a third conductive non-magnetic reed, and
b. said first reed is positioned intermediate said second and third reeds.
49. A reed switch as in claim 27 and including:
a. a plurality of said magnetic operators cooperating with each other and in cooperating spaced relation to said reeds.
50. A reed switch as in claim 27 and wherein:
a. said operator is a horseshoe magnet.
51. A reed switch comprising:
a. a first reed of conductive magnetic material
b. a second reed of conductive non-magnetic material mounted in cooperating spaced relation to said first reed
c. a cooperating pair of magnetic operators mounted in cooperating spaced relation to said first and second reeds
d. said reeds being positioned between said pair of operators, and
e. at least some of said operators and said reeds being movable relative to each other.
52. A reed switch as in claim 51 and wherein:
a. said operators include at least one permanent magnet.
53. A reed switch as in claim 51 and wherein:
a. said operators include a pair of permanent magnets.
54. A reed switch as in claim 51 and wherein:
a. said operators iclude at least one electromagnet.
55. A reed switch as in claim 51 and wherein:
a. said magnetic operators are positioned to operate when the magnetic flux lines are greater than 45° with respect to the plane of the reeds.
56. A reed switch as in claim 51 and wherein:
a. said magnetic operators when operating are aiding.
57. A reed switch as in claim 51 and wherein:
a. said magnetic operators when operating are opposing.
58. A reed switch as in claim 51 and wherein:
a. said magnetic operators are rotatable about said reeds.
59. A reed switch as in claim 51 and wherein:
a. at least one of said magnetic operators includes polarity reversing means.
60. A reed switch as in claim 59 and wherein:
a. said polarity reversing means includes at least one rotatable permanent magnet.
61. A reed switch as in claim 59 and wherein:
a. said polarity reversing means includes at least one electromagnet.
62. A reed switch as in claim 51 and wherein:
a. at least one of said magnetic operators is rotatable on its axis.
63. A reed switch as in claim 51 and wherein:
a. at least one of said magnetic operators is linearly movable.
64. A reed switch as in claim 51 and wherein:
a. said first reed is positioned approximately mid-way between said operators.
65. A reed switch as in claim 51 and wherein:
a. said first reed is positioned closer to one of said operators than the other.
66. A reed switch as in claim 51 and wherein:
a. at least one of said magnetic operators is movable along an axis substantially parallel to the plane of said reed.
67. A reed switch as in claim 51 and including:
a. a third reed, and
b. a first reed being positioned intermediate said second and third reeds.

* * * * *